US011231169B2

(12) United States Patent
Hou et al.

(10) Patent No.: US 11,231,169 B2
(45) Date of Patent: Jan. 25, 2022

(54) DOWNLIGHT APPARATUS

(71) Applicant: XIAMEN ECO LIGHTING CO. LTD., Xiamen (CN)

(72) Inventors: Shouqiang Hou, Xiamen (CN); Yongzhe Dong, Xiamen (CN); Xiaoliang Wen, Xiamen (CN); Zhenkun Huang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 202 days.

(21) Appl. No.: 16/503,625

(22) Filed: Jul. 5, 2019

(65) Prior Publication Data

US 2020/0217493 A1 Jul. 9, 2020

(30) Foreign Application Priority Data

Jan. 4, 2019 (CN) ..... 201920013124.1

(51) Int. Cl.

| | |
|---|---|
| ***F21V 29/10*** | (2015.01) |
| ***F21S 8/02*** | (2006.01) |
| ***F21V 29/71*** | (2015.01) |
| ***F21V 7/00*** | (2006.01) |
| ***H05B 45/20*** | (2020.01) |

(52) U.S. Cl.

CPC ..... *F21V 29/10* (2015.01); *F21S 8/024* (2013.01); *F21S 8/026* (2013.01); *F21V 7/0016* (2013.01); *F21V 29/71* (2015.01); *H05B 45/20* (2020.01)

(58) Field of Classification Search

CPC ..... F21V 29/10; F21V 29/71; H05B 45/20
See application file for complete search history.

(56) References Cited

U.S. PATENT DOCUMENTS

2016/0348861 A1* 12/2016 Bailey ..... F21V 7/28
2017/0263673 A1* 9/2017 Kiba ..... H01L 33/507

* cited by examiner

*Primary Examiner* — Anne M Hines
(74) *Attorney, Agent, or Firm* — Chun-Ming Shih; Lanway IPR Services

(57) ABSTRACT

A downlight apparatus includes a main housing, and a light module and an optical module both arranged inside the main housing. The downlight apparatus also includes a fire resistant enclosure arranged at a rearward side of the main housing. The fire resistant enclosure is detachably coupled to the main housing. The main housing and the fire resistant enclosure form a compartment. A driving module having a communication board is arranged inside the compartment.

18 Claims, 10 Drawing Sheets

DOWNLIGHT APPARATUS

FIELD

The present invention is related to a downlight apparatus, and more particularly related to a downlight apparatus with a removable fire resistant enclosure.

BACKGROUND

A downlight apparatus is a built-in directional lighting fixture, which is embedded in a target location, such as arranged in a receptacle on a ceiling, a wall or a fire tube. The North American downlight is a downlight certified by Underwriter Laboratories Inc. (UL), and is characterized by its safety and reliability. Typically, a downlight apparatus includes a surface ring, a light reflecting cup, a driving module, and a light module, . . . etc. The existing North American downlights are equipped with mounting cylinders for assembly, which makes the North American downlights not suitable for some new buildings, and limits the range of use of the downlights.

SUMMARY OF INVENTION

In some embodiments, the downlight apparatus includes a main housing, a light module and an optical module both arranged inside the main housing. The downlight apparatus also includes a fire resistant enclosure arranged at a rearward side of the main housing. The fire resistant enclosure is detachably coupled to the main housing. The main housing and the fire resistant enclosure form a compartment, and there is a driving module arranged inside the compartment.

The fire resistant enclosure may include a cover and a case. The cover may be arranged at a rearward end of the fire resistant enclosure distal to the main housing, and is detachably coupled to the case.

The main housing may include a heat sink and a surface ring.

The optical module may include a first optical component and a second optical component. The light emitted from the light module could passes through the first optical component toward the second optical component.

Further, the second optical component could be held fixed inside the main housing and covers the light module.

The first optical component may be a lens or a light transmitting cover. The second optical component may include a light reflecting surface for reflecting light emitted from the light module toward a forward direction.

In some embodiments, the second optical component includes high thermal conductivity material for heat dissipation, and may be may be spaced out 0-5 mm apart from the first optical component.

In some embodiments, the light module includes a substrate and a plurality of LED chips located on the substrate. The plurality of LED chips includes a first group of LED chips capable of emitting light with a first color temperature, and a second group of LED chips capable of emitting light with a second color temperature. The first color temperature is different from the second color temperature.

In some embodiments, the first group of LED chips and the second group of LED chips are interspersedly arranged on the substrate.

In some embodiments, the driving module may include a driving box, a communication board and a driving board. The communication board and the driving board are arranged inside the driving box, and the communication board is electrically connected to the driving board. The communication board may be arranged vertical to the driving board.

In some embodiments, the driving module further includes a controller for controlling the light module to emit light with different color temperatures, and/or for controlling the light module to emit light with different luminance. The controller may include a switch selector or a variable resistor.

In some embodiments, the downlight further includes an installation module to facilitate installation of the downlight apparatus to a receptacle on the ceiling or the wall.

In some embodiments, the downlight apparatus further includes a replacement ring configured to be installed onto the surface ring.

DETAILED DESCRIPTION

The present disclosure will be further described in detail below with reference to the accompanying drawings and embodiments. It is understood that the specific embodiments described herein are merely illustrative of the claimed invention and are not intended to limit the claimed invention.

Figure 1:
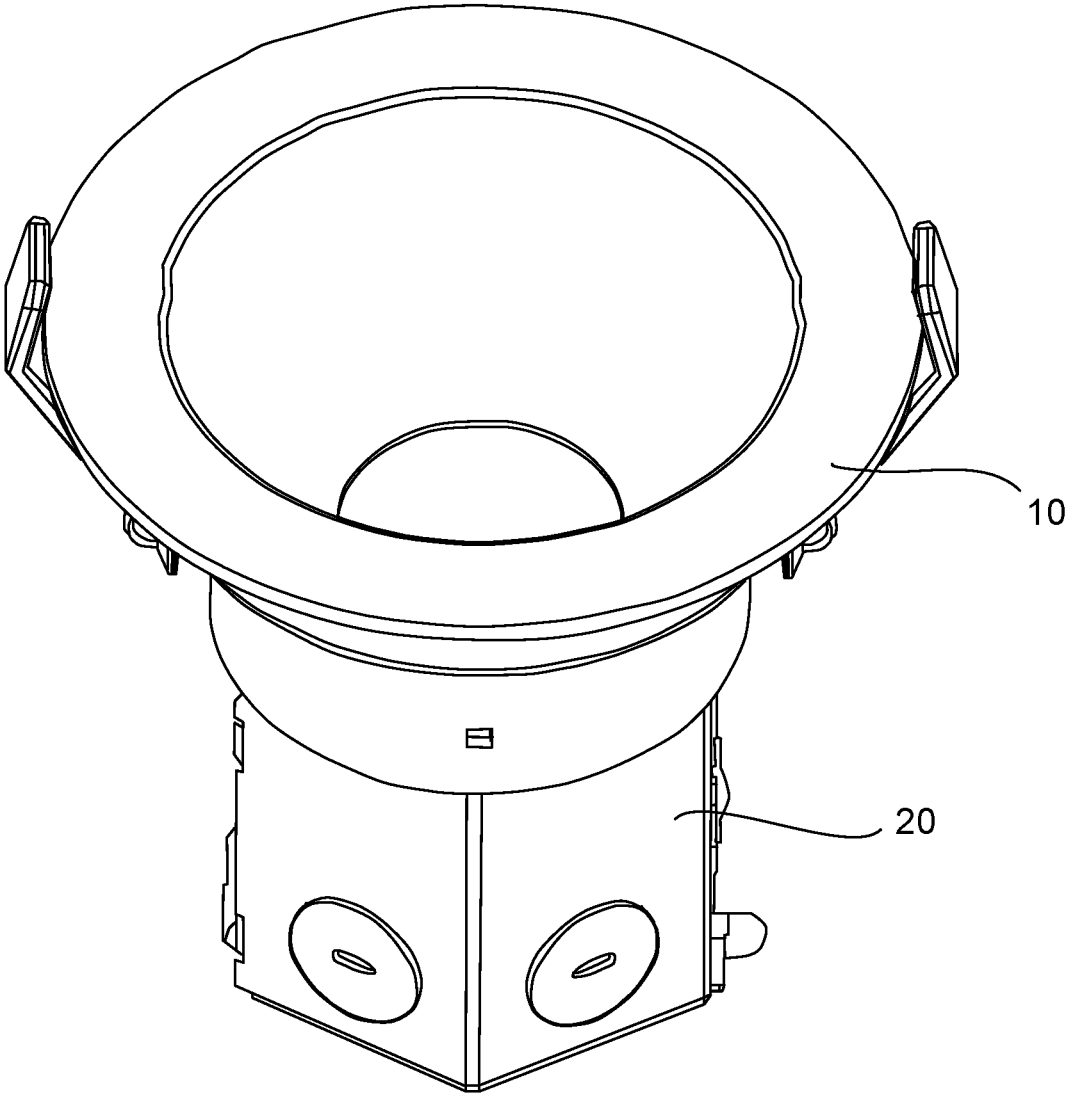
FIG. 1 is a perspective view showing the downlight apparatus in accordance with one embodiment of the present disclosure.
Figure 2:
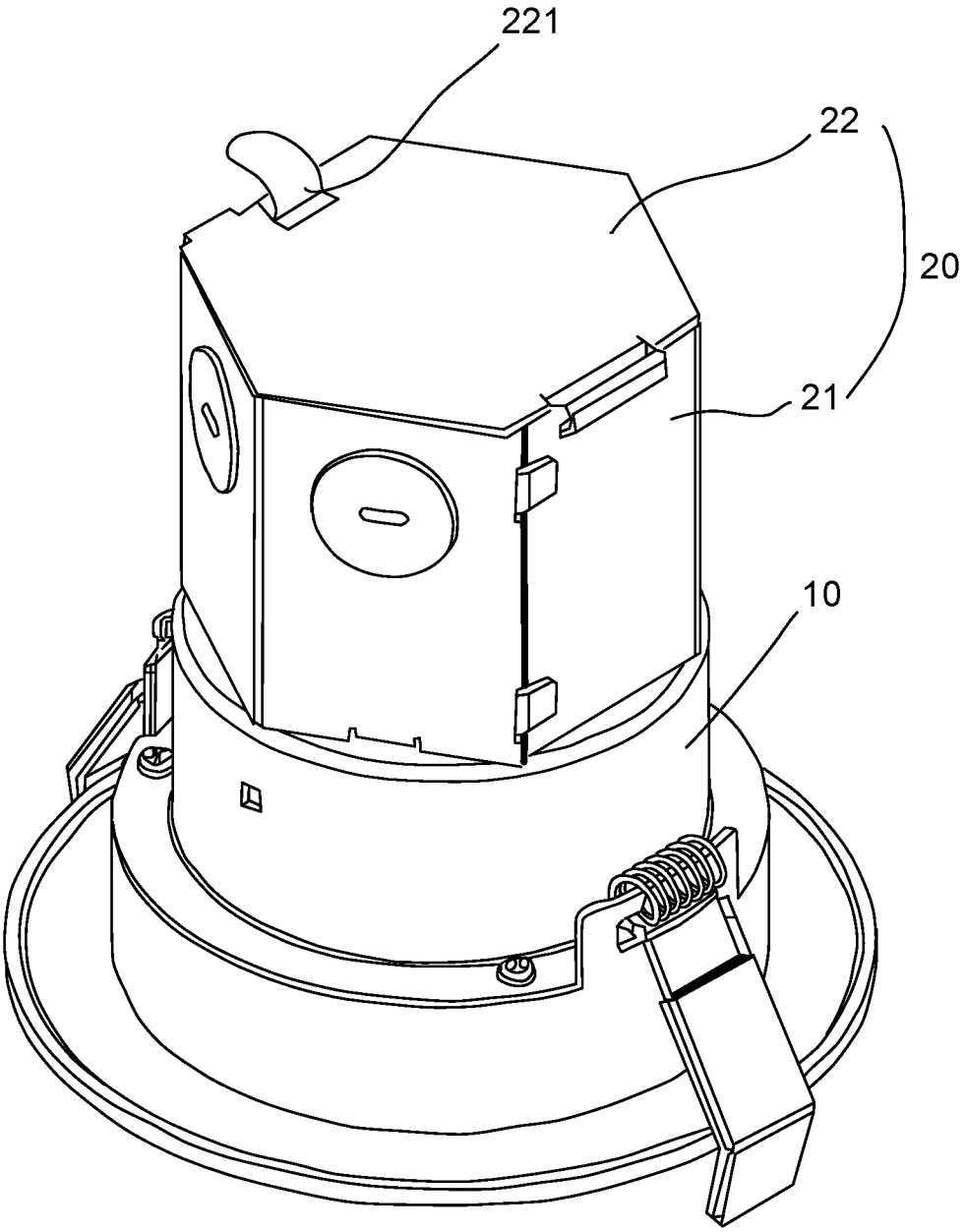
FIG. 2 is another perspective view showing the downlight apparatus in accordance with one embodiment of the present disclosure.
Figure 3:
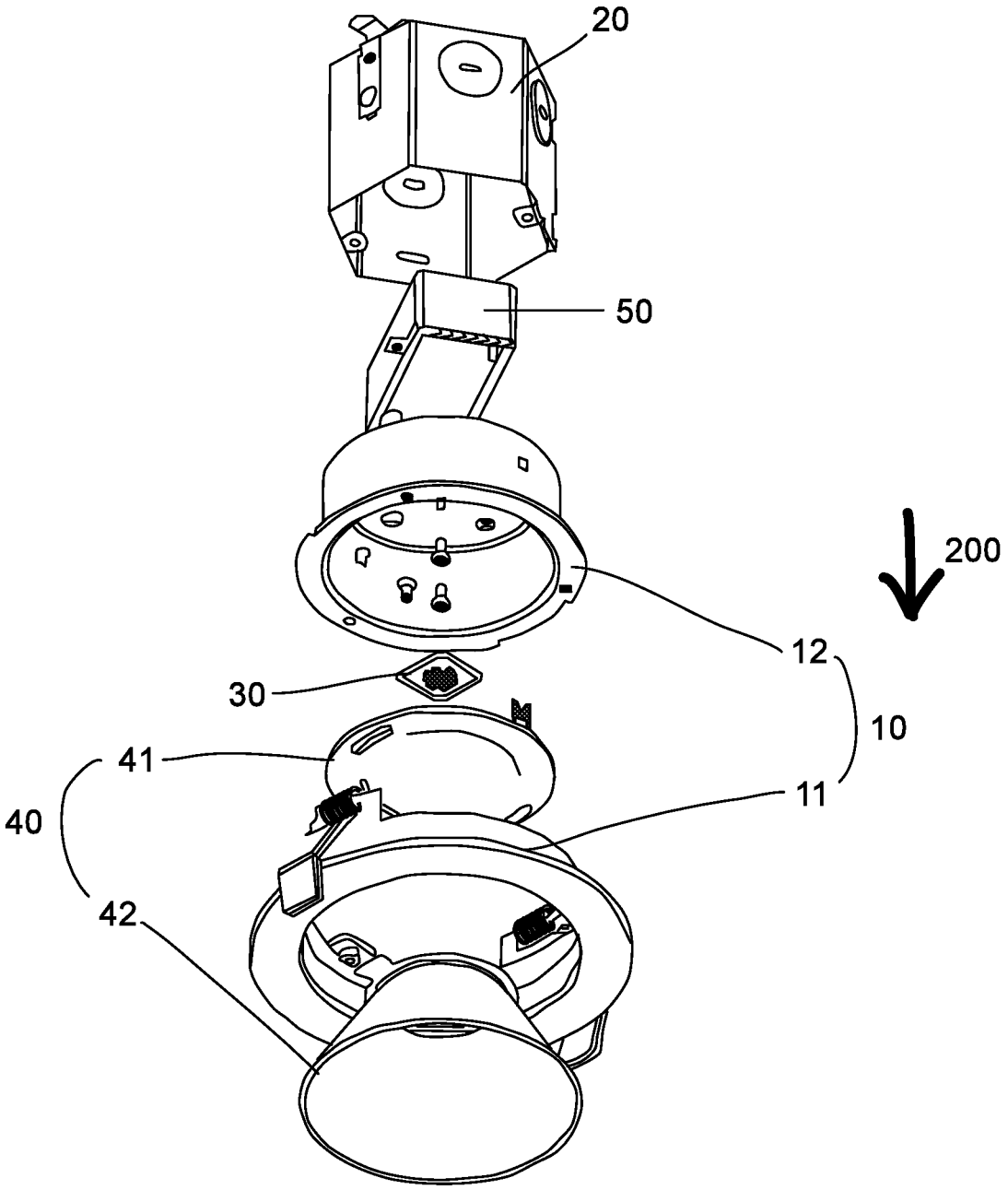
FIG. 3 is an exploded view of the downlight apparatus in accordance with one embodiment of the present disclosure.

Refer to FIG. 1 to FIG. 3. In a first embodiment, the downlight apparatus includes a main housing 10, a light module 30 and an optical module 40. Both the light module 30 and the optical module are arranged inside the main housing 10. The optical module 40 covers the light module 30, such that the light beams generated by the light module 30 are emitted out via the optical module 40. The downlight apparatus also includes a fire resistant enclosure 20 arranged at a rearward side of the main housing 10. The fire resistant enclosure 20 is detachably coupled to the main housing 10. The main housing 10 and the fire resistant enclosure 20 together form a compartment. The driving module 50 is arranged inside the compartment, and the driving module 50 is electrically connected to the light module 30.

In one embodiment, the fire resistant enclosure 20 is detachable from the main housing 10. The fire resistant enclosure 20 is an optional component depending on whether the fire resistant enclosure 20 is needed for the downlight apparatus to be properly installed. In the case where the downlight apparatus is to be installed into a receptacle on a ceiling or a wall, the fire resistant enclosure 20 may be assembled onto the main housing 10, so the downlight could be directly installed onto the ceiling or the wall. In the case where there is already a mounting cylinder in place, the fire resistant enclosure 20 may be removed from the main housing 10, so the downlight apparatus could be properly installed into the mounting cylinder. With such arrangement, the downlight apparatus may be easily adapted to be properly installed in various occasions.

Figure 4:
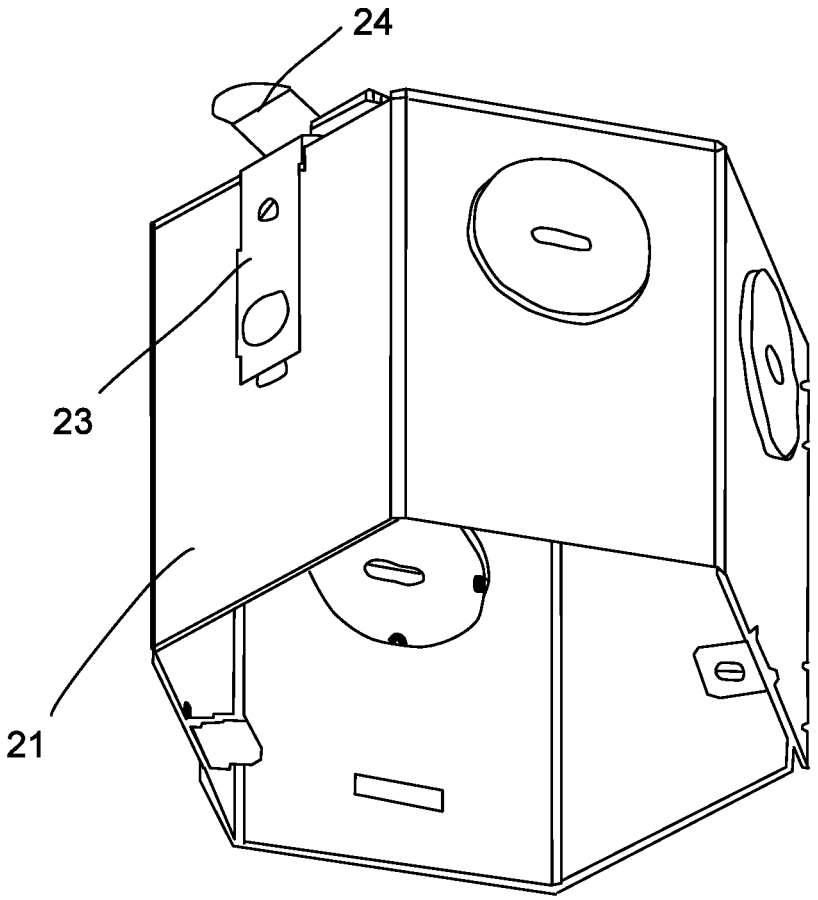
FIG. 4 is a schematic view of the fire resistant enclosure in accordance with one embodiment of the present disclosure.

Refer to FIG. 2 and FIG. 4, the fire resistant enclosure 20 includes a case 21 and a cover 22. The cover 22 is arranged at a rearward end of the fire resistant enclosure 20 distal to the main housing 10, and the cover 22 is detachably coupled to the case 21. The case 21 covers the driving module 50, and the case 21 is mechanically coupled to the main housing 10.

In an example, the case 21 may include a cylindrical structure, and the cross section may be a hexagonal shape, a circular shape, or the like. The shape of the cover 22 matches the shape of the cross section of the case 21, and the dimension of the cover 22 matches that of the case 21. When the cover 22 is attached to the case 21, the cover 22 covers an opening of the case 21 located away from main housing 10 and forms an accommodating space. In the embodiment, the fire resistant enclosure 20 is made by material having fireproof properties, such as metal or plastic material.

Further, in order to facilitate the assembly of the driving module 50, the cover 22 is detachably from the case 2. Thus, the assembly procedure of the downlight apparatus may be simplified, and the production efficiency of the downlight apparatus may be enhanced. In this embodiment, as shown in FIG. 4, an elastic piece 23 is disposed at an end of the case 21 away from the main housing 10, and the elastic piece 23 extends toward the cover 22 and a bending portion 24 of the elastic piece 23 protrudes from the case 21. The cover 22 is provided with a limiting hole 221, and the limiting hole 221 is configured to engage with the elastic piece 23.

The bending portion 24 of the elastic piece 23 passes through the limiting hole 221 and is bent along a direction away from the cover 22. It can be understood that the side of the cover 22 corresponding to the limiting hole 221 is fixed to the case 21 by a rotating member. When the elastic piece 23 is to be disengaged from the limiting hole 221, the cover 22 may be rotated with respect to the case 21, such that the cover 22 does not cover one end of the case 21 facing away the main housing 10. In this way, the driving module 50 may be disassembled via the opening. As an example, the rotating member may be a rotation shaft.

Refer to FIG. 3. The main housing 10 includes a heat sink 12 and a surface ring 11. The surface ring 11 is detachable from the heat sink 12, and the surface ring 11 may be made by metal material such as aluminum, iron, copper, etc. In another example, the surface ring 11 may be made by plastic material, such as PA thermal conductive material, PBT, PC, PS, ABS, etc. It can be understood that the heat sink 12 can also be made by metal material (e.g., aluminum, iron, copper, . . . etc.) or plastic material (e.g., PA thermal conductive material, PBT, PC, PS, ABS, . . . etc.) The heat sink 12 may be made by a material the same as or different from the material of the surface ring 11.

The optical module 40 includes a first optical component 41 and a second optical component 42. The light emitted from the light module 30 could pass through the first optical component 41 toward the second optical component 42. The first optical component 41 connects to the main housing 10 and covers the light module 30. The second optical component 42 is held fixed inside the main housing 10.

The second optical component 42 connects to the main housing 10, and is arranged in front of the first optical component 41. The light beams generated by the light module 30 pass through the first optical component 41 and the second optical component 42. With such arrangement, the heat of the light beams may be dissipated twice. Not only the uniformity of the light beams may be enhanced, but also the scope of light emission angle may be broadened. In one embodiment, the light emission angle may range from 25 to 120 degrees.

The first optical component 41 may be a lens or a light transmitting cover. The first optical component 41 may cover the light module 30. The second optical component 42 may be a light reflective cup, which includes a light reflecting surface for reflecting light emitted from the light module 30 toward a forward direction 200. The second optical component 42 may include high thermal conductivity material to facilitate heat dissipation.

The shape of the second optical component 42 is compatible with the shape of the main housing 10. When the second optical component 42 is assembled within the main housing 10, an external surface of the second optical component 42 adheres to an internal surface of the main housing 10. As such, the main housing 10 may support the second optical component 42. At the same time, the end of the second optical component 42 facing away the first optical component 41 aligns with the end of the main housing 10 facing away the fire resistant enclosure 20. In this way, not only the aesthetics of the downlight apparatus can be improved, but also the concentration of the light beams emitted by the downlight apparatus can be improved.

In one embodiment, the second optical component 42 may be detachable from the main housing 10. In another embodiment, the second optical component 42 is a light reflecting cup arranged within the main housing 10, and the light reflecting cup surrounds the light module 30. The light reflecting cup has a narrow opening and a wide opening. The narrow opening is located near the light module 30, and the wide opening of the light reflecting cup is located away the light module 30. The first optical component 41 connects to the light reflecting cup and covers the wide opening of the light reflecting cup, such that the light beams passing through the light reflecting cup may emit out via a translucent plate. In another embodiment, the second optical component 42 may be implemented by lens, where the lens adheres to the main housing 10 so as to form a reflective surface.

In addition, the surface of the first optical component 41 facing toward the second optical component 42 engages and contacts with the surface of the second optical component 42 facing toward the first optical component 41. As such, all of the light beams emitted from the first optical component 41 enter the second optical component 42, which reduces the loss of the light beams. In order to avoid the thermal expansion affects the engagement between the first optical component 41 and the second optical component 42, a gap may be arranged between the first optical component 41 and the second optical component 42 according to the expansion coefficients of the first optical component 41 and the second optical component 42. In a preferred embodiment, a gap ranging from 0-5 mm is arranged.

As shown in FIG. 3, the fire resistant enclosure 20 may be detachable from the main housing 10. When the downlight apparatus is configured to be used with the fire resistant enclosure 20, the fire resistant enclosure 20 is coupled to the main housing 10 by a connecting part. The downlight apparatus may be installed into a mounting surface, e.g., a receptacle of a ceiling, via the fire resistant enclosure 20. In this way, the fire resistant enclosure 20 not only contributes to the heat dissipation of the driving module 50, but also prevents the driving module 50 from being overheated. In addition, the safety of the downlight apparatus may be enhanced.

In one embodiment, the connecting part includes a buckle and a card slot. The buckle and the card slot are respectively disposed on the fire resistant enclosure 20 and the main housing 10, such that the fire resistant enclosure 20 may be detached from the main housing 10 via the buckle and the card slot. It can be understood that the connecting part may have other alternatives, and is not limited to the above.

Figure 5:
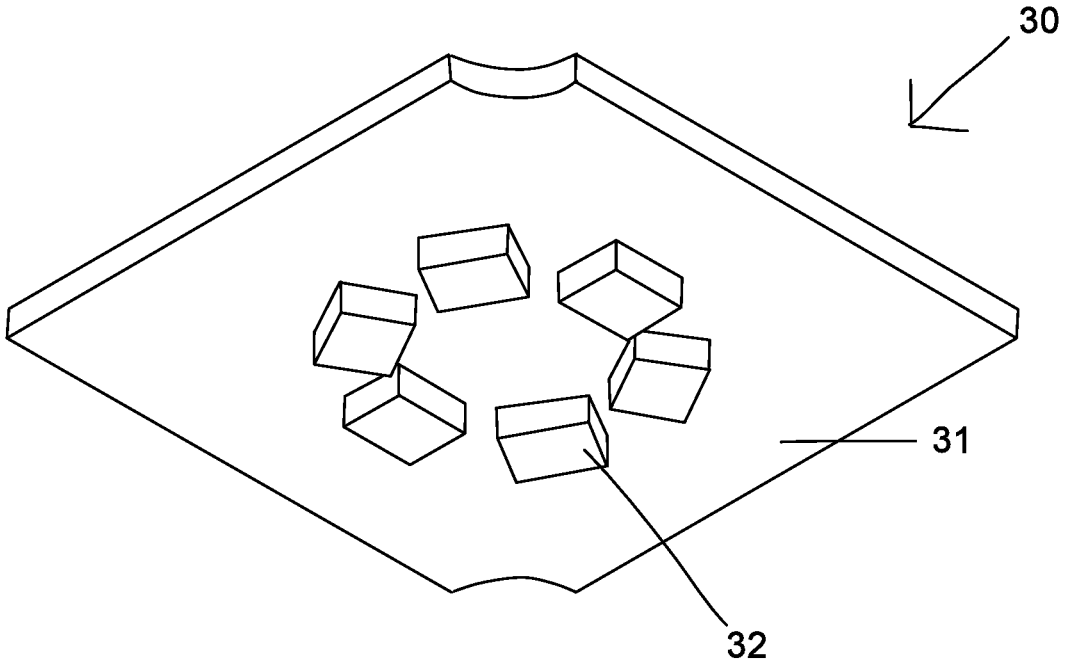
FIG. 5 is a schematic view of the light module in accordance with one embodiment of the present disclosure.

Refer to FIG. 5. The light module 30 includes a substrate 31 and a plurality of LED chips 32 located on the substrate 31. The plurality of LED chips 32 includes at least two groups of LED chips, and each group of LED chips is capable of emitting light with different color temperatures. For example, the plurality of LED chips 32 may include a first group of LED chips capable of emitting light with a first color temperature, and a second group of LED chips capable of emitting light with a second color temperature. The first color temperature is different from the second color temperature. The color temperature may be, for example, 2835 k, 3030 k, 5050 k, or 5630 k. The first group of LED chips and the second group of LED chips are interspersedly arranged on the substrate.

Figure 6:
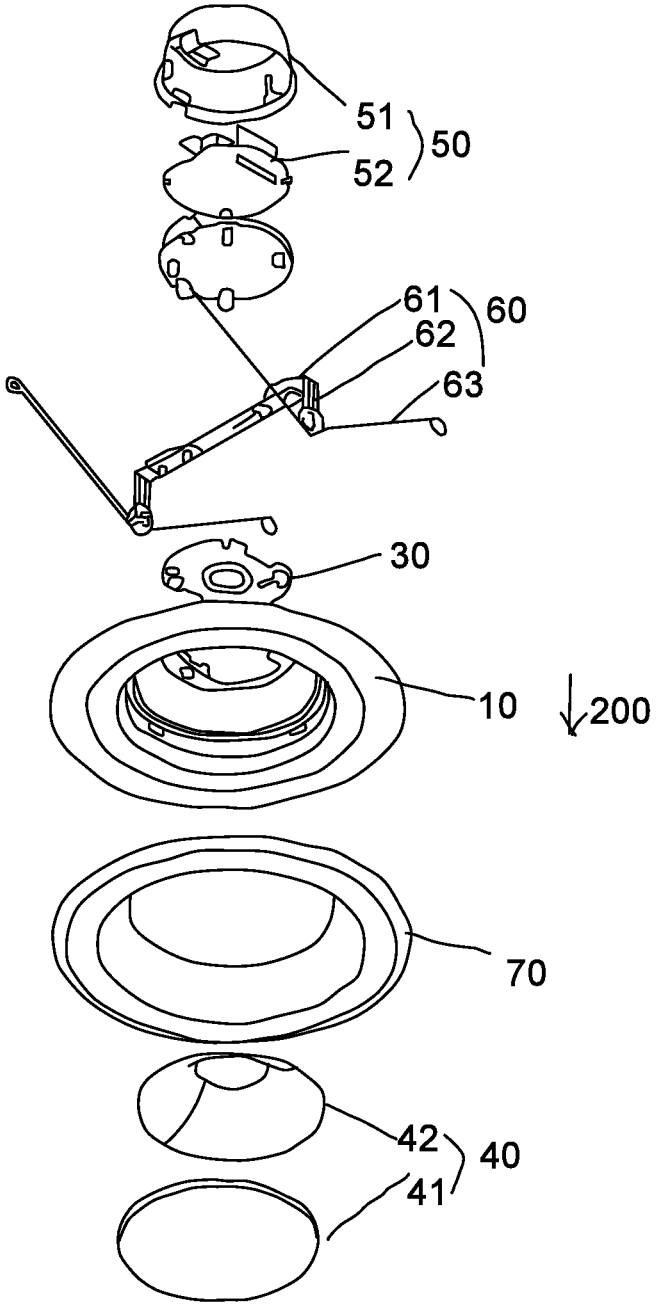
FIG. 6 is a schematic view of the downlight apparatus in accordance with one embodiment of the present disclosure, where the fire resistant enclosure is removed.
Figure 7:
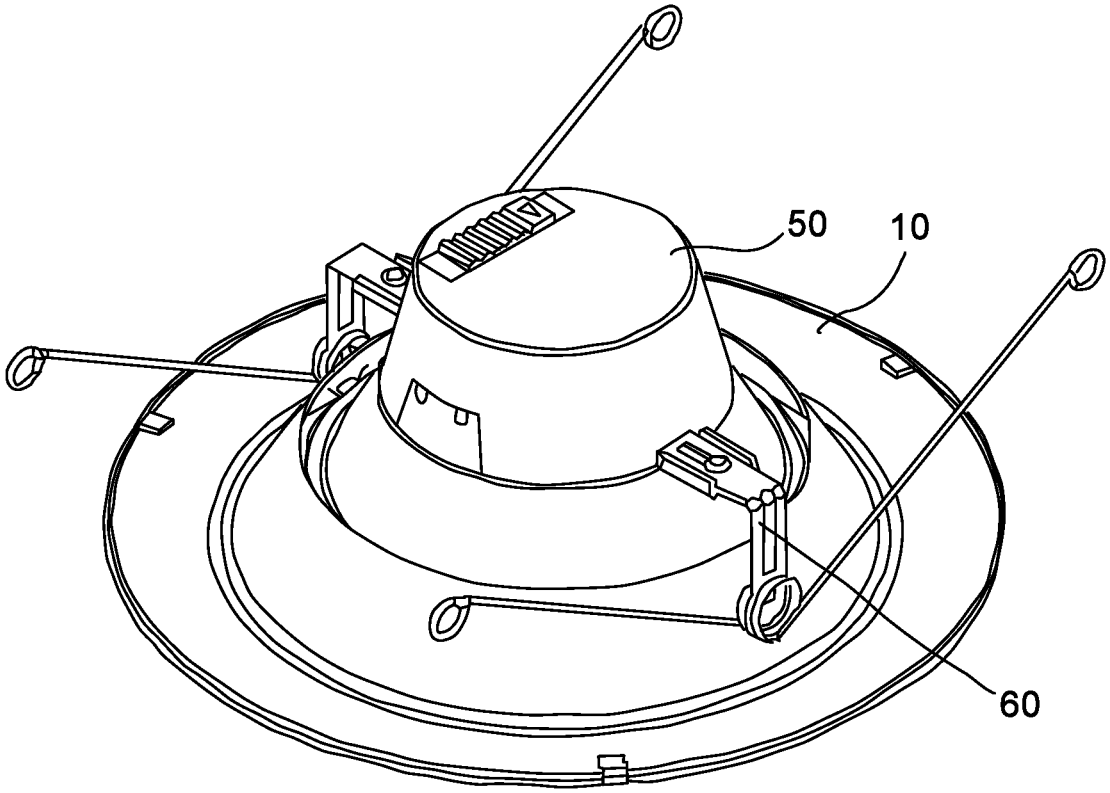
FIG. 7 is a perspective view of the downlight apparatus in accordance with one embodiment of the present disclosure, where the fire resistant enclosure is removed.
Figure 8:
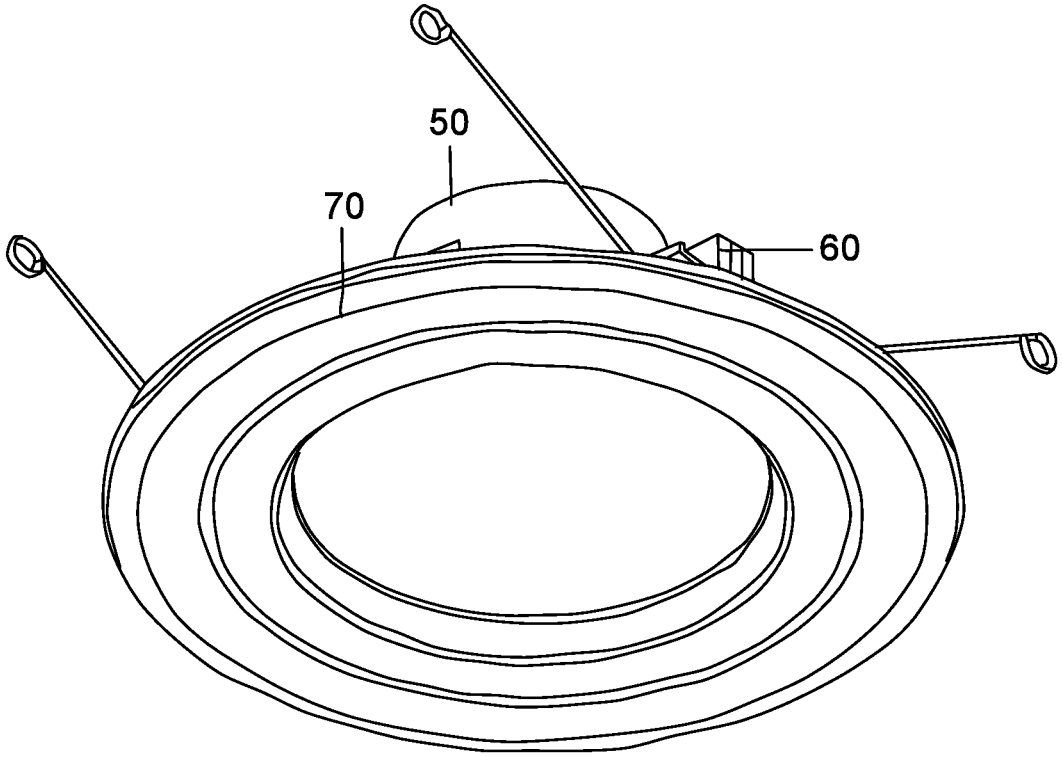
FIG. 8 is another perspective view of the downlight apparatus in accordance with one embodiment of the present disclosure, where the fire resistant enclosure is removed.

Refer to FIGS. 6-8. The downlight apparatus further includes an installation module 60 to facilitate installation of the downlight apparatus to a receptacle of the ceiling or the wall.

The installation module 60 is arranged between the main housing 10 and the driving module 50, and may be detachable. The downlight apparatus may be installed on the mounting surface, e.g., a receptacle of a ceiling, via the installation module 60. The installation module 60 may include two springs 63, two brackets 62, and a crossbar 61. The crossbar 61 is configured to contact with one end of the main housing 10 facing away from the light module 30. The two brackets 62 are respectively arranged at both ends of the crossbar 61. The two brackets 62 are bent toward the main housing 10, and in contact with the main housing 10. The brackets 62 are configured to engage with the spring 63, and the downlight apparatus may be installed on the main housing 10 via the springs 63. When the installation module 60 is to be installed on the main housing 10, the fire resistant enclosure 20 is removed from the main housing 10.

As shown in FIG. 6. The downlight apparatus may also include a replacement ring 70 configured to be installed onto the surface ring 10. The replacement ring 70 may be made by metal material such as aluminum, iron, copper, . . . etc. In another example, the replacement ring 70 may be made by plastic material, such as PA thermal conductive material, PBT, PC, PS, ABS, . . . etc. In addition, the external surface of the replacement ring 70 may be colored by white, nickel-color, bronze . . . etc.

Figure 9:
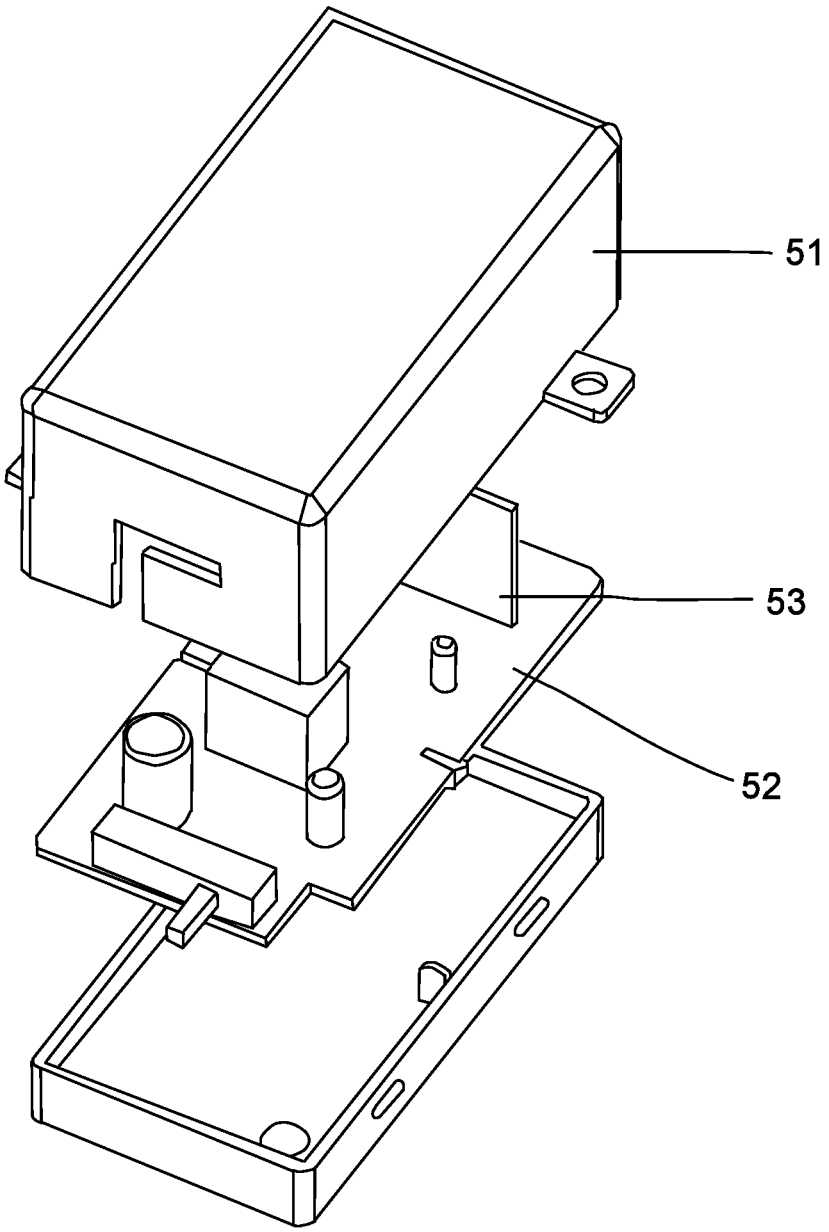
FIG. 9 is a schematic view of the driving module in accordance with one embodiment of the present disclosure.

Referring to FIG. 9, the driving module 50 includes a driving box 51, a driving board 52, and a communication board 53. The communication board 53 and the driving board 52 are arranged inside the driving box 51. The communication board 53 is physically arranged vertical to the driving board 52, and is electrically connected to the driving board 52. One end of the communication board 53 electrically connects to the driving component 52, and the other end of the communication board 53 extends away from the driving component 52, and the communication board 53 is arranged perpendicular to the driving component 52. Thus, the driving component 52 may receive wireless control signals from external devices, such as cellular phones, tablets, and control panels via the communication board 53. In one embodiment, the communication board 53 is electrically connected to the driving component 52 by soldering. The communication board 53 may include an internal antenna or an external antenna. The communication board 53 receives wireless signals and converts the wireless signals into baseband digital or analog signals to control the downlight apparatus in a variety of ways, such as dimming, color grading, switching, etc. The communication board 53 may receive wireless signals such as Bluetooth signals, WiFi signals, IrDaA signals and Zigbee signals . . . etc. The communication board 53 may use the CSR1010 chip provided by Qualcomm. In addition, it should be noted that the shape of the communication board 53 may be square, rectangular, circular or other shapes.

Figure 10:
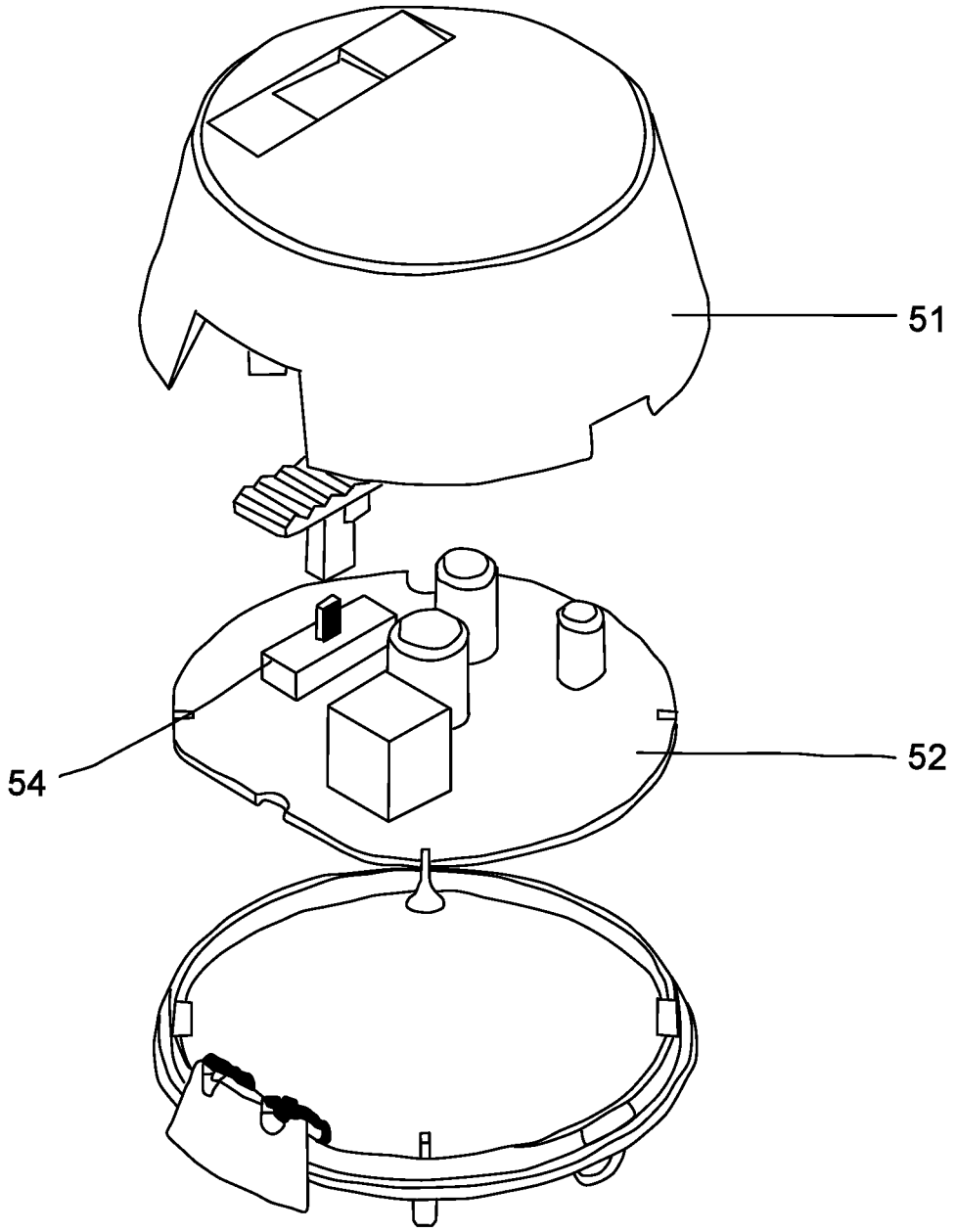
FIG. 10 is a schematic view of the driving module in accordance with one embodiment of the present disclosure.

Refer to FIG. 10. In this embodiment, the driving module 50 further includes a controller 54 for controlling the light module 30 to emit light with different color temperatures, and/or for controlling the light module to emit light with different luminance. The controller 54 may include a switch selector or a variable resistor. The toggle switch may be a single-control switch or a dual-control switch. If the toggle switch is a dual-control switch, one of the toggle switches may be used to control dimming, and the other switch may be used to control the color temperature.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

We claim:

1. A downlight apparatus, comprising:

a main housing;

a light module and an optical module both arranged inside the main housing;

a fire resistant enclosure arranged at a rearward side of the main housing, wherein the fire resistant enclosure is detachably coupled to the main housing, and the main housing and the fire resistant enclosure form a compartment; and a driving module arranged inside the compartment, wherein the driving module includes a driving box, a communication board and a driving board, wherein the communication board and the driving board are arranged inside the driving box, and the communication board is electrically connected to the driving board.

2. The downlight apparatus of claim 1, wherein the fire resistant enclosure includes a cover and a case, wherein the cover is arranged at a rearward end of the fire resistant enclosure distal to the main housing, and the cover is detachably coupled to the case.

3. The downlight apparatus of claim 1, wherein the main housing includes a heat sink and a surface ring.

4. The downlight apparatus of claim 1, wherein the optical module includes a first optical component and a second optical component, and light emitted from the light module passes through the first optical component toward the second optical component.

5. The downlight apparatus of claim 4, wherein the second optical component is held fixed inside the main housing and covers the light module.

6. The downlight apparatus of claim 4, wherein the first optical component is a lens or a light transmitting cover.

7. The downlight apparatus of claim 4, wherein the second optical component includes a light reflecting surface for reflecting light toward a forward direction.

8. The downlight apparatus of claim 4, wherein the second optical component includes high thermal conductivity material for heat dissipation.

9. The downlight apparatus of claim 4, wherein the second optical component is spaced out 0-5 mm apart from the first optical component.

10. The downlight apparatus of claim 1, wherein the light module includes a substrate and a plurality of LED chips located on the substrate, and the plurality of LED chips includes a first group of LED chips capable of emitting light with a first color temperature, and a second group of LED chips capable of emitting light with a second color temperature different from the first color temperature.

11. The downlight apparatus of claim 10, wherein the first group of LED chips and the second group of LED chips are interspersed on the substrate.

12. The downlight apparatus of claim 1, wherein the communication board is arranged vertical to the driving board.

13. The downlight apparatus of claim 1, wherein the driving module further includes a controller for controlling the light module to emit light with different color temperatures.

14. The downlight apparatus of claim 13, wherein the controller includes a switch selector or a variable resistor.

15. The downlight apparatus of claim 1, wherein the driving module further includes a controller for controlling the light module to emit light with different luminance.

16. The downlight apparatus of claim 15, wherein the controller includes a switch selector or a variable resistor.

17. The downlight apparatus of claim 1, wherein the downlight further includes an installation module to facilitate installation of the downlight apparatus to a receptacle.

18. The downlight apparatus of claim 1, wherein the downlight apparatus further includes a replacement ring configured to be installed onto the surface ring.

* * * * *